US008215022B2

(12) United States Patent
Feizi et al.

(10) Patent No.: US 8,215,022 B2
(45) Date of Patent: Jul. 10, 2012

(54) LUBRICATION SYSTEM FOR A FOOD PRODUCT SLICER

(75) Inventors: Fariborz Feizi, Savannah, GA (US); Shahram Shariff, Savannah, GA (US); Brian Stump, Englewood, OH (US)

(73) Assignee: Premark FEG L.L.C., Wilmington, DE (US)

( * ) Notice: Subject to any disclaimer, the term of this patent is extended or adjusted under 35 U.S.C. 154(b) by 980 days.

(21) Appl. No.: 12/281,482

(22) PCT Filed: Mar. 2, 2007

(86) PCT No.: PCT/US2007/063121

§ 371 (c)(1),
(2), (4) Date: Sep. 3, 2008

(87) PCT Pub. No.: WO2007/103761

PCT Pub. Date: Sep. 13, 2007

(65) Prior Publication Data

US 2009/0064876 A1 Mar. 12, 2009

Related U.S. Application Data

(60) Provisional application No. 60/780,422, filed on Mar. 8, 2006.

(51) Int. Cl.
*B26D 7/06* (2006.01)

(52) U.S. Cl. ..... 30/388; 30/390; 30/515; 30/240; 30/263; 30/264; 30/276; 30/347; 83/331; 83/334; 83/340; 83/341; 83/342; 83/469; 83/471

(58) Field of Classification Search ..... 30/388, 30/389, 390, 515, 240, 263, 264, 276, 347; 83/331, 334, 338, 340, 341, 342, 469, 471, 83/186, 187, 189
See application file for complete search history.

(56) References Cited

U.S. PATENT DOCUMENTS

| | | | | |
|---|---|---|---|---|
| 1,760,670 | A * | 5/1930 | Streckfuss | 83/167 |
| 2,062,862 | A * | 12/1936 | Calame | 384/13 |
| 5,755,194 | A * | 5/1998 | Moorman et al. | 123/196 W |
| 2003/0079595 | A1 * | 5/2003 | Shariff et al. | 83/713 |
| 2008/0271584 | A1 * | 11/2008 | Repaci | 83/471 |

FOREIGN PATENT DOCUMENTS

| | | |
|---|---|---|
| DE | 491760 | 2/1930 |
| DE | 500133 | 6/1930 |
| GB | 311211 | 5/1929 |
| GB | 438208 | 11/1935 |

OTHER PUBLICATIONS

PCT, International Preliminary Report on Patentability, PCT/US2007/063121 (Sep. 18, 2008).
PCT, International Search Report and Written Opinion, PCT/US2007/063121 (Jul. 11, 2007).

* cited by examiner

*Primary Examiner* — Benjamin Layno
(74) *Attorney, Agent, or Firm* — Thompson Hine LLP

(57) ABSTRACT

A food product slicer includes a base and a knife mounted for rotation relative to the base. A slide rod extends in a direction past the knife. A carriage assembly is mounted for reciprocal movement back and forth past a cutting edge of the knife. At least one bearing arrangement connects the carriage assembly to the slide rod to facilitate the reciprocal movement of the carriage assembly. The bearing arrangement includes a lubricant reservoir. A bearing bracket holds a bearing that rides on the slide rod. The lubricant reservoir is fluidly connected to deliver lubricant to the slide rod in proximity to the bearing.

16 Claims, 7 Drawing Sheets

LUBRICATION SYSTEM FOR A FOOD PRODUCT SLICER

CROSS-REFERENCES

This application claims the benefit of U.S. provisional application Ser. No. 60/780,422, filed Mar. 8, 2006.

TECHNICAL FIELD

The present application relates generally to food product slicers of the type commonly used to slice bulk food products and, more particularly, to a lubrication system for the carriage of a food product slicer.

BACKGROUND

Typical reciprocating food slicers have a rotatable, circular or disc-like slicing blade, an adjustable gauge plate for determining the thickness of the slice and a carriage which is mounted on a slide rod within the slicer housing for supporting the food as it is moved back and forth past the cutting edge of the knife during slicing. During operation, a lubricant is applied to the slide rod to allow the carriage to move back and forth in a smooth manner for efficient slicing. A felt material saturated with oil is typically brought into contact with the slide rod and bearings in order to provide such lubrication.

It would be desirable to provide a lubrication system that provides an appropriate, consistent amount of lubricant to the slide rod, and that also provides a method for recycling any excess lubricant. It would also be desirable to provide a lubrication system that provides an appropriate, consistent amount of lubricant to the slide rod, and that also includes a lubricant reservoir located away from the higher temperatures that can be generated in the vicinity of the bearing and slide rod.

SUMMARY

In one aspect, a food product slicer includes a base and a knife mounted for rotation relative to the base. A slide rod extends in a direction past the knife. A carriage assembly is mounted for reciprocal movement back and forth past a cutting edge of the knife. At least one bearing arrangement connects the carriage assembly to the slide rod to facilitate the reciprocal movement of the carriage assembly. The bearing arrangement includes a lubricant reservoir. A bearing bracket holds a bearing that rides on the slide rod. The lubricant reservoir is fluidly connected to deliver lubricant to the slide rod in proximity to the bearing.

In another aspect, a food product slicer includes a base and a knife mounted for rotation relative to the base. A slide rod extends in a direction past the knife. A carriage assembly is mounted for reciprocal movement back and forth past a cutting edge of the knife. At least one bearing arrangement connects the carriage assembly to the slide rod to facilitate the reciprocal movement of the carriage assembly. The bearing arrangement includes a lubricant reservoir located below the slide rod and a bearing bracket holding a bearing that rides on the slide rod. The lubricant reservoir is connected with the bearing bracket. A wick has a lower portion within the reservoir. The wick extends upward through the bearing bracket and includes a portion extending over and in contact with the top of the slide rod. The bearing bracket includes a lubricant collecting groove facing the slide rod. The lubricant collecting groove is in fluid communication with the lubricant reservoir for delivering lubricant from the slide rod back down into the reservoir.

DETAILED DESCRIPTION

Figure 1:
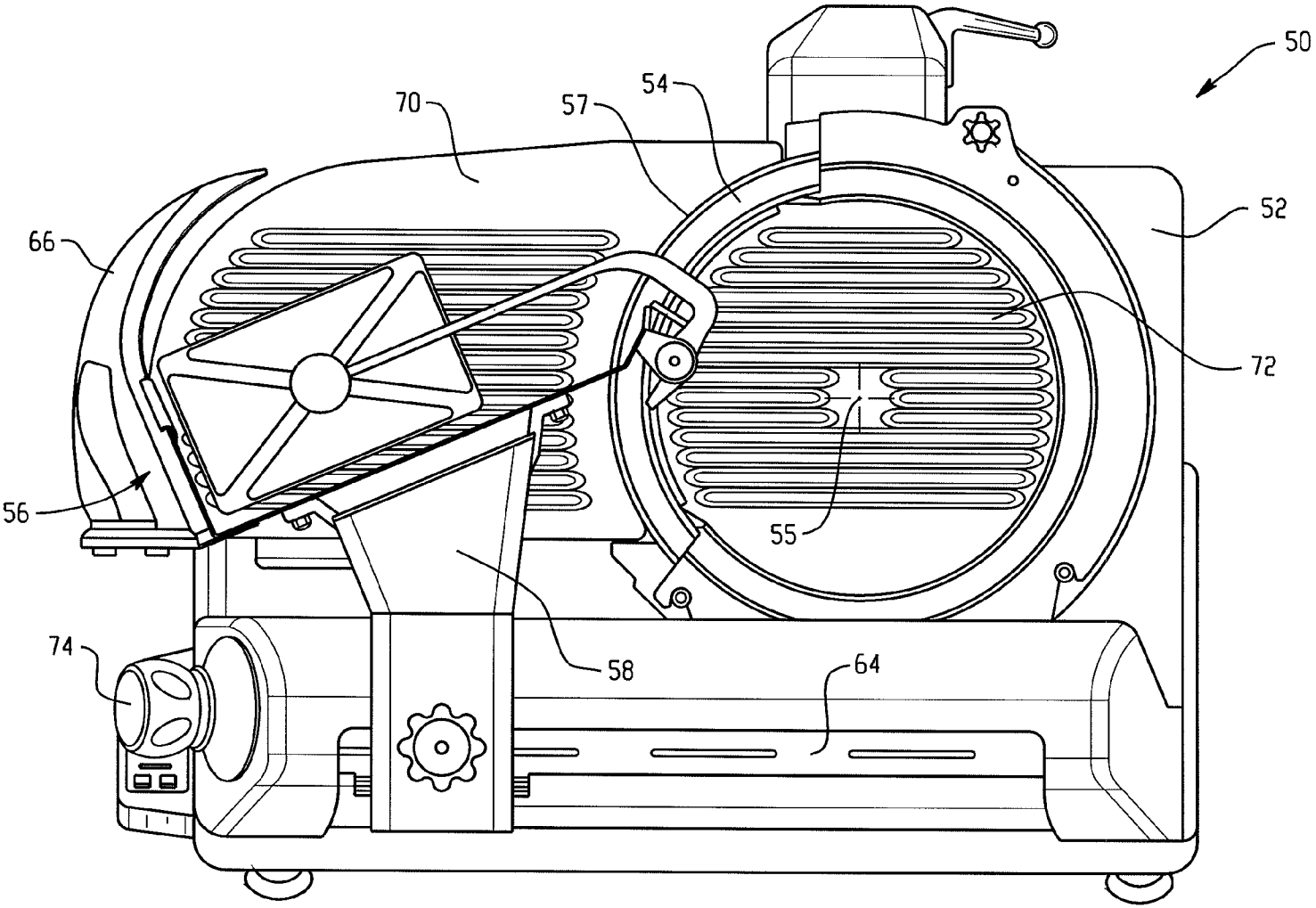
FIG. 1 is a side elevation of a slicer.

Referring to FIG. 1, a food product slicer 50 includes a housing or base 52 and a circular, motor-driven slicing knife 54 that is mounted to the housing for rotation about an axis 55. The left side of FIG. 1 is generally referred to as the front side of the slicer (which is where an operator stands for slicing), the right side of FIG. 1 is generally referred to as the rear side of the slicer and FIG. 1 depicts a right side view of the slicer. A food product can be supported on a manually operable food carriage 56 which moves the food product to be sliced past the cutting edge 57 of the rotating slicing knife 54. The food carriage 56 reciprocates from left to right relative to FIG. 1, along a linear path so that the lower end of the bulk food product slides along the surface of the gauge plate 70, is cut by the knife 54 and then slides along a knife cover plate 72. Food carriage 56 includes a tray mounted on a tray arm 58 that orients the food carriage tray at the appropriate angle (typically perpendicular) to the cutting edge plane. The food carriage reciprocates in a slot 64 at a lower portion of the housing 52 and a handle 66 is mounted to the food carriage 56. The handle is graspable by a user and can be used to manually move the food carriage. The carriage may also be automatically driven (e.g., as by a motor drive or other prime mover). A handle 74 for adjusting the gauge plate to control slice thickness is also shown.

Figure 2:
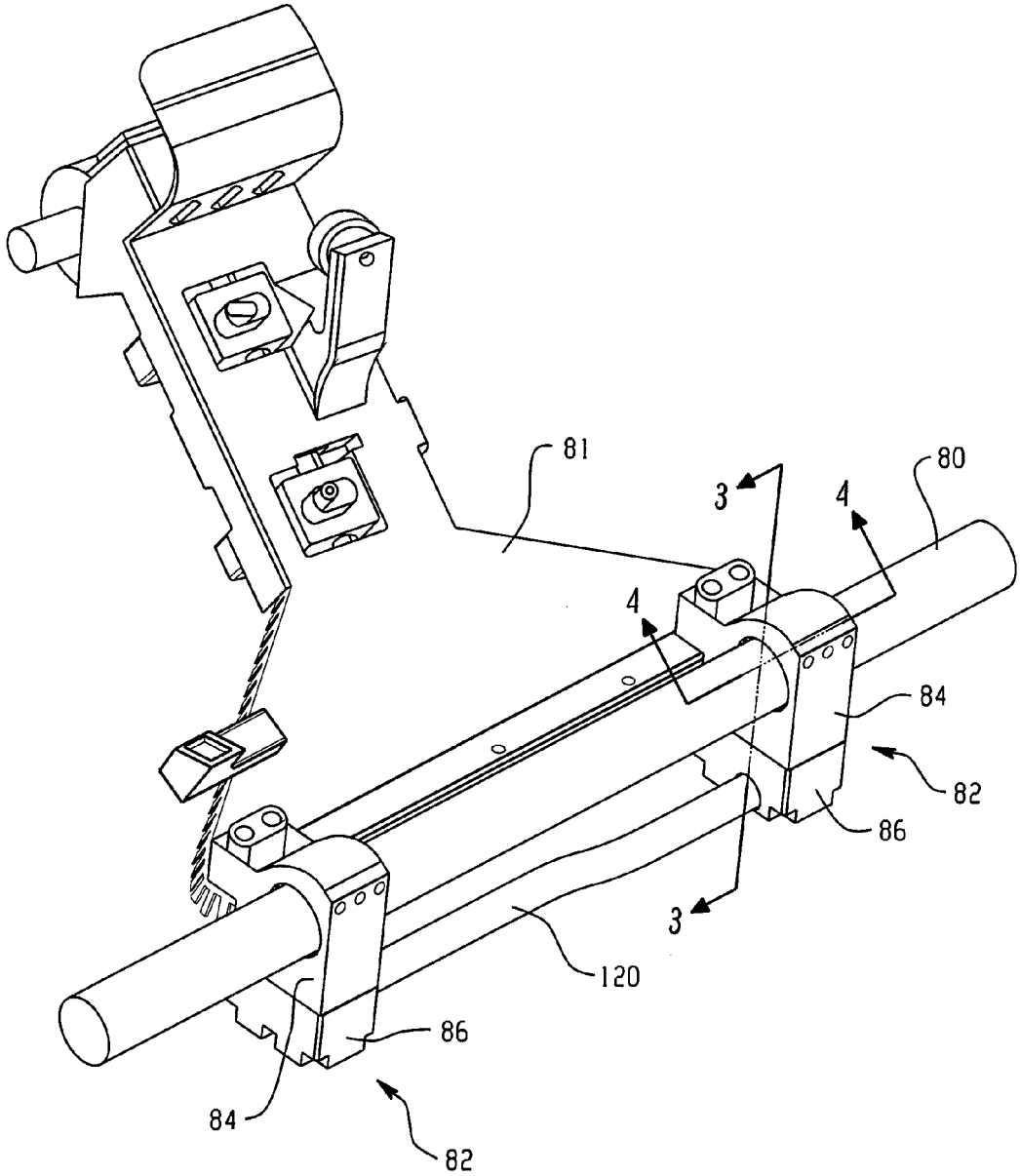
FIG. 2 is a partial perspective of an internal slide rod, bearing and carriage arrangement of the slicer.

The slicer also includes a slide rod 80 per FIG. 2. The slide rod may extend almost the entire front to rear length of the slicer, is typically stationary and substantially cylindrical having a generally circular cross-section. However, other cross-sections conducive to permit sliding therealong could also be used. The internal portion 81 of the carriage assembly is connected with the slide rod 80 via spaced apart bearing assemblies 82. The end of the carriage portion 81 protrudes from the slicer body slot 64 (FIG. 1) and the tray arm connects to such end portion. Referring again to FIG. 2, the bearing assembly 82 includes an upper bearing bracket 84 and a lower reservoir 86 for holding lubricant for delivery to the slide rod 80. In one embodiment, the lubricant is oil. The reservoir may be maintained below the slide rod in order to prevent a continuous transfer of lubricant to the slide rod as a result of pressure head created by gravity. The bearing bracket and reservoir may be formed of any suitable material, such as metal or durable plastics. It is also contemplated that the reservoir could be formed of a clear plastic (e.g., Grilamid TR 70 LX available from EMS-Grivory) to enable an operator to visually determine how much lubricant remains in the reservoir.

Figure 3:
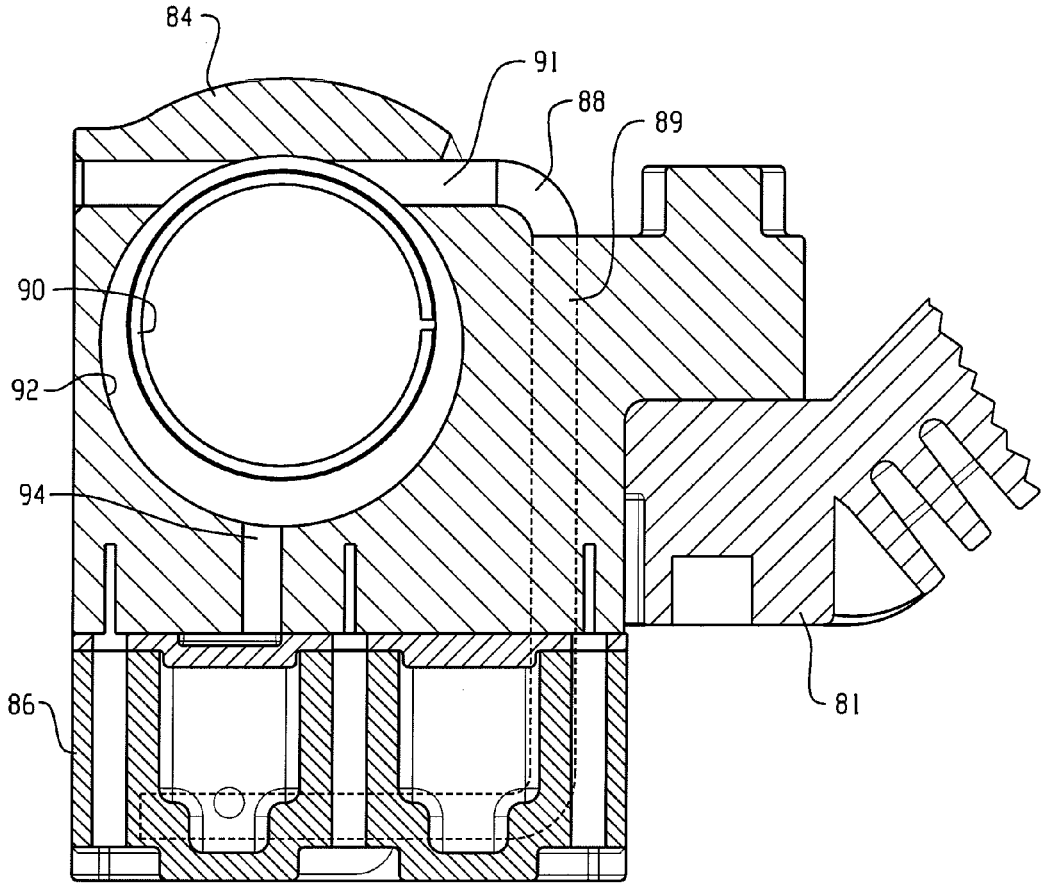
FIG. 3 is a partial cross-section of a bearing arrangement along line 3-3 of FIG. 2.
Figure 4:
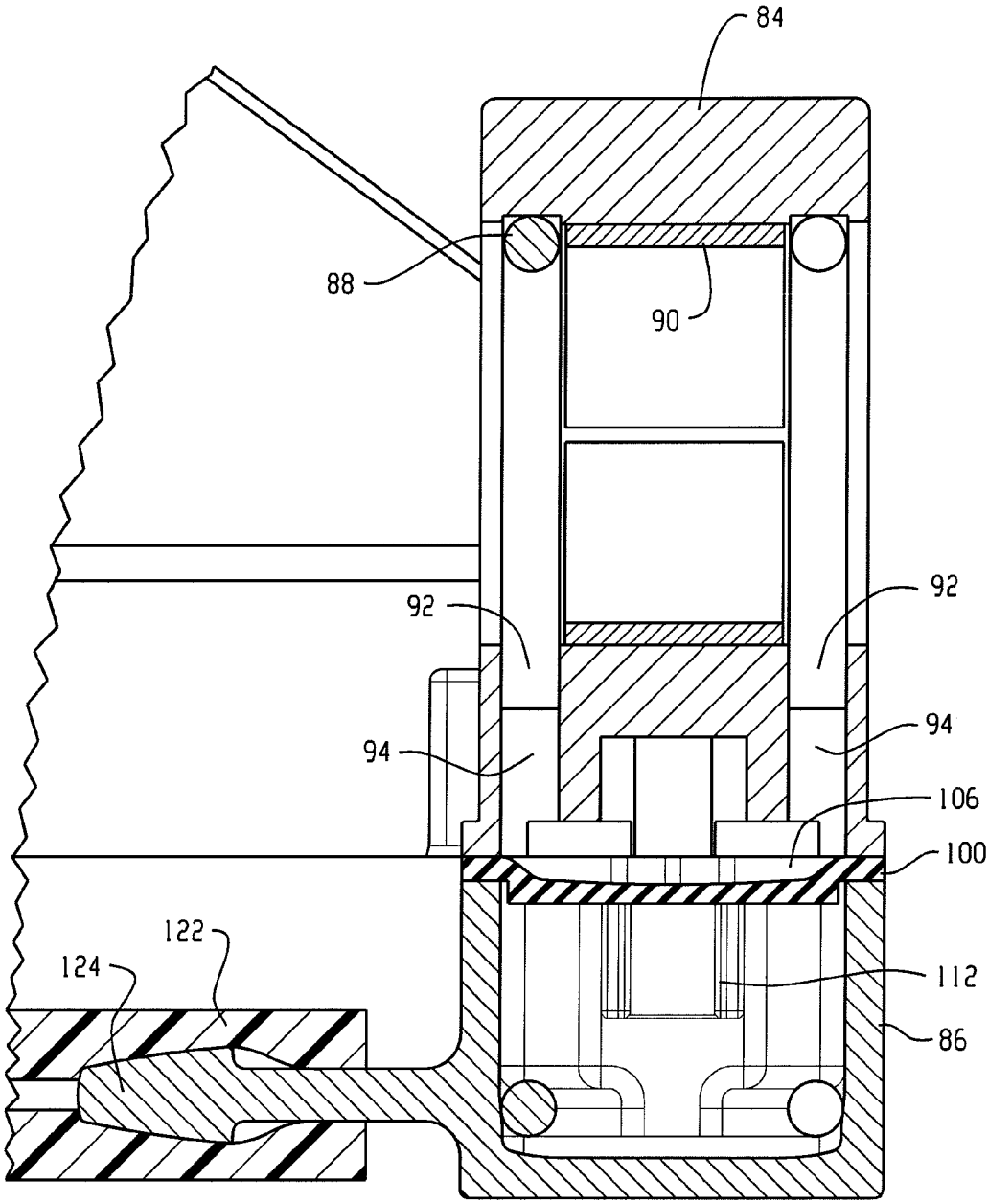
FIG. 4 is a partial cross-section of the bearing arrangement along line 4-4 of FIG. 2.

Referring to FIGS. 3 and 4, a wick 88, preferably of felt material or other material that would allow capillary action, is used to transfer the lubricant from the reservoir to the top of the slide rod. As demonstrated by the position of the upper portion of the wick, the wick will be in contact with the top of a slide rod (not shown) that extends through the bearing 90. A vertical extending wick path 89 and a horizontally extending wick path 91 are provided for positioning of the wick. The transfer is accomplished by capillary action along the wick. The required pressure head to transfer the lubricant upward from the reservoir to the top of the slide rod is developed by the capillary action of fibers in the wick. The distance that the lubricant can travel above the reservoir and the level of wear resistance depend on the type of material used in the wick. In one embodiment, a small diameter, Type F1 felt material with the highest capillarity or wicking height and highest resistance to wear may be used, but variations are possible. The amount or quantity of lubricant that is deposited on the slide rod is controlled by the size of the cross section area of the wick 88 and the amount of surface contact between the wick and the slide rod. The lubricant travels from the reservoir to the top of the slide rod but does not drain off of the wick automatically due to the higher molecular attraction force between the lubricant and the wick 88, than the lubricant and the slide rod.

In operation, as the carriage moves linearly along the slide rod the lubricant on the wick in the area of contact between the wick and the slide rod is pulled from the wick to the slide rod. As the wick loses some of the lubricant during this process, additional pressure head is created by the capillary action of the fibers, which causes additional lubricant to move up from the reservoir to the wick. The lubricant is delivered to the slide rod in proximity to the bearing. As used herein delivery of lubricant to the slide rod "in proximity to the bearing" means delivery of lubricant to a portion of the slide rod that is axially aligned with (e.g., overlapped by) the bearing or that is axially alongside to the bearing. As used herein As the lubricant collects on the top of the slide rod, the bearings 90 sliding over the rod, wipe the excess lubricant from the slide rod. The bearings then transfer the lubricant to ring grooves 92 located in the bearing bracket at both ends of the bearing. The ring grooves 92 operate to collect any excess lubricant and direct the excess to the lowest point on the ring grooves. As shown, the ring grooves may be shaped as recesses that extend further away from the bearing at lower portions thereof. At the lowest point of each ring groove, a hole 94 is provided for delivering collected lubricant back to the reservoir. As a result, lubricant is recycled and the need for a user to add more lubricant to the reservoir in order to maintain required lubricant level is reduced.

The above described cycle of lubricant flow continues as long as the slicer is in operation, i.e., as long the carriage is moving along the slide rod. The cycle stops when the carriage is not moving on the slide rod. This prevents the consumption of lubricant when the slicer is not in use.

Figure 5:
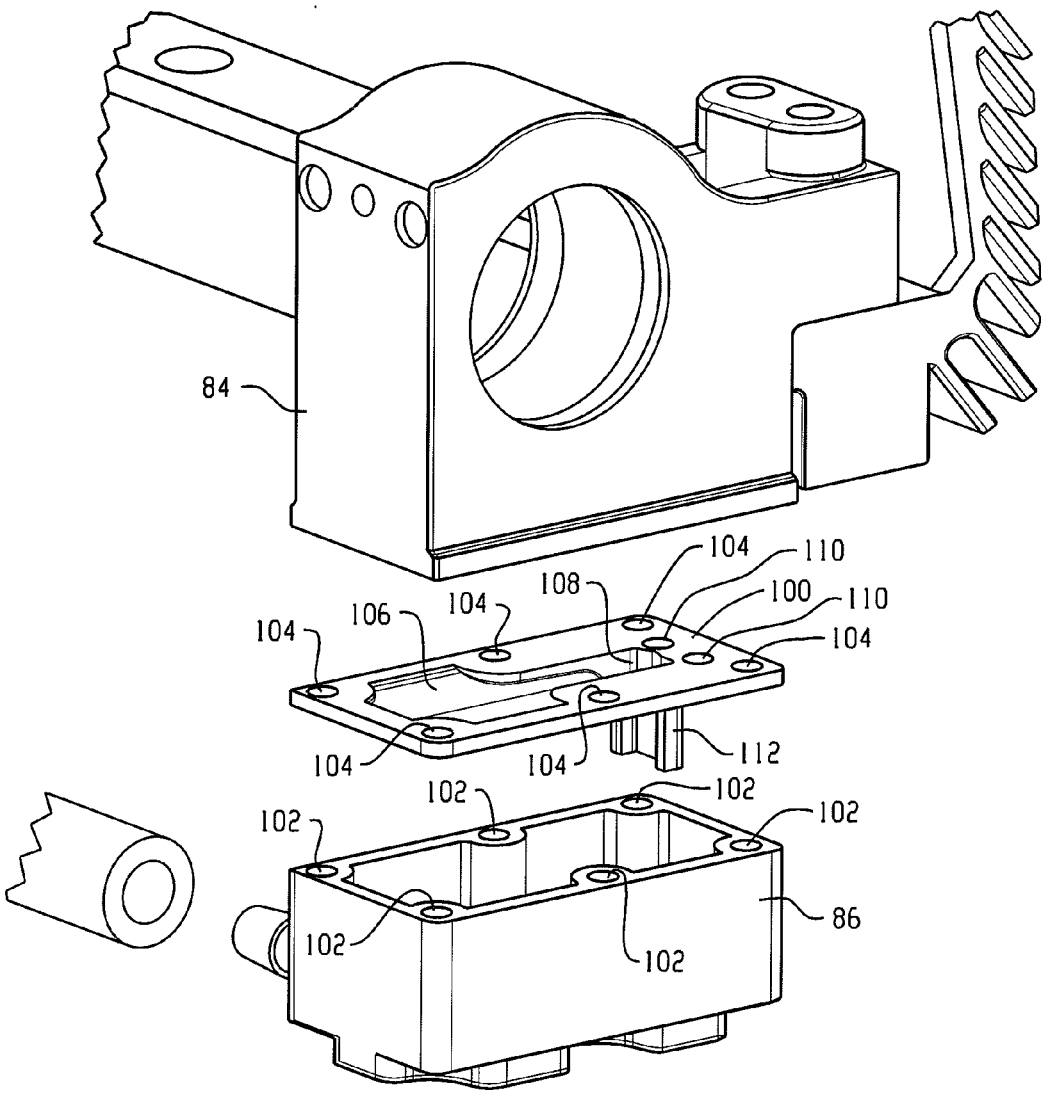
FIG. 5 is an exploded partial perspective of the bearing arrangement.

Referring to FIG. 5, a seal member 100 is provided between the bearing bracket 84 and the reservoir 86. The periphery of the sealing member seals the connection between the bracket and the reservoir. Such connection may be achieved using multiple fasteners that extend upward through openings 102 in the reservoir and corresponding aligned openings 104 in the sealing member 100, with such fasteners being threaded into downwardly facing openings (not shown) in the bottom of the bearing bracket. The central portion of the sealing member 100 includes a recessed trough 106 into which lubricant travels as is drains from the ring grooves. The trough 106 slopes downward slightly toward one side to deliver lubricant to an opening 108 that communicates with the reservoir 86. By locating the opening 108 in an offset manner from the ring groove drain opening 94, the sealing member also serves a function of preventing lubricant from having a direct, straight path back up into the ring groove from the reservoir under turbulent conditions, such as when the slicer is being moved or when the carriage is moving back and forth during slicing. Further, by positioning the opening 108 to one side, when the slicer is tilted upward for maintenance, a substantial majority (e.g., 80% or more) of the lubricant will remain below the opening limiting backflow up into the ring groove. In this regard, most slicers are configured to be tilted from a specific side, typically the carriage side, and the sealing member 100 can be oriented accordingly. Wick openings 110 are also provided through the sealing member.

Figure 6:
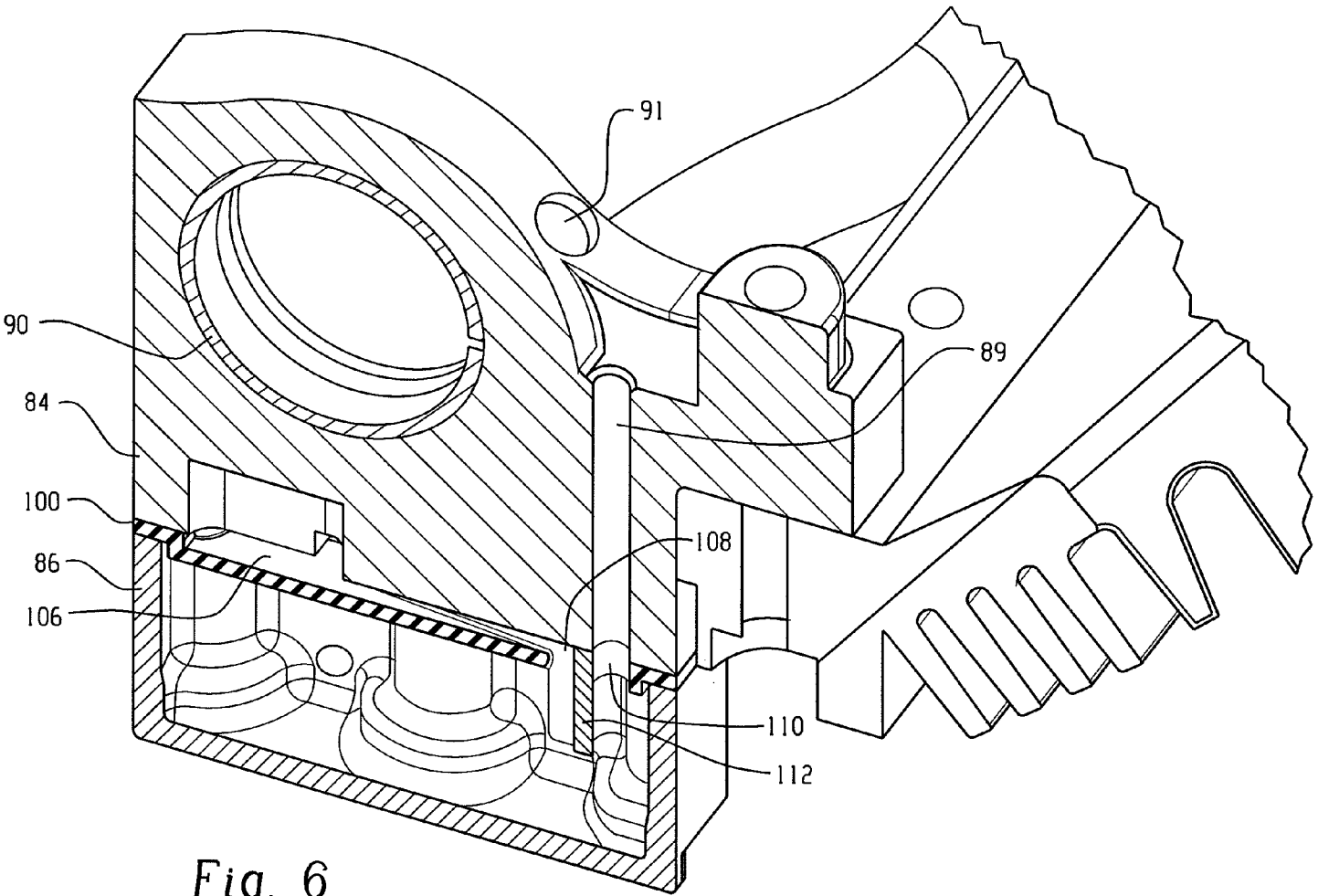
FIG. 6 is a cut away view of an assembled bearing arrangement.

As best seen in FIG. 6, the sealing member also includes a downwardly extending wall 112 located between the opening 108 and the wick opening 110 so that lubricant flowing back into the reservoir will not flow directly onto the wick. This feature prevents any dirt or other deposits that may be flowing in the lubricant from being placed directly onto the wick. As shown, the wall 112 extends downward and has a lower end spaced above the bottom of the reservoir.

Figure 7:
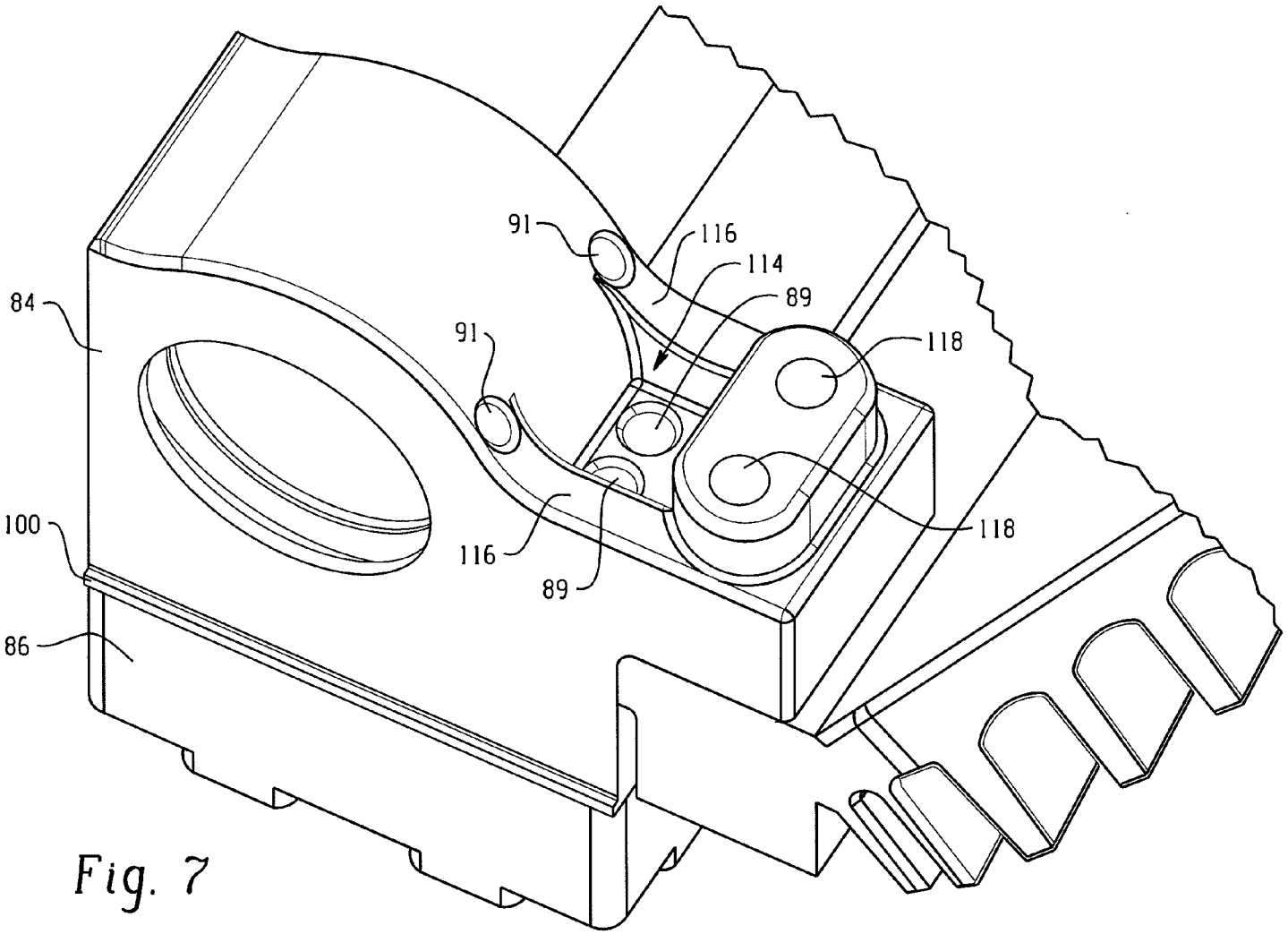
FIG. 7 is a partial perspective from the upper side of the bearing arrangement.

Referring to FIG. 7, the upper side of the bearing bracket 84 may include a lubricant fill recess 114 located between walls 116. The wick paths 89 extend upward into the recess 114. In normal use, and as suggested in FIG. 4, only a single wick is used in connection with each bearing assembly, and that wick is placed along the path 89, 91 that is located innermost along the slide rod. Accordingly, the unused wick path 89 is left as a reservoir refill port. Having the recess 114 facilitates refill by enabling a user to simply deliver oil into the recess without concern that the oil may spill off the bearing bracket before traveling down the refill port. Openings 118 for connecting the bearing bracket to the carriage via suitable fasteners are also shown.

As best seen in FIGS. 2 and 4, the two bearing assemblies located at opposite ends of the interior carriage portion 81 may also include a connecting flow path 120 between the reservoirs 86. This connecting flow path is useful in that in some cases recirculation of oil back to the reservoirs may be higher for one reservoir than the other. The flow path 120 maintains lubricant levels in the two reservoirs substantially the same. In the illustrated embodiment the path 120 is formed by a tube 122 that connected to a projecting port connector 124 that is hollow. However, other path configurations could be provided.

It is to be clearly understood that the above description is intended by way of illustration and example only and is not intended to be taken by way of limitation. For example, variations in the shape and size of the bearing bracket and reservoir are possible. Moreover, while the illustrated wick is shown with a circular cross-section, it is contemplated that non-circular wicks could also be used. Other changes and modifications could be made.

What is claimed is:

1. A food product slicer, comprising:

a base;

a knife mounted for rotation relative to the base;

a slide rod extending in a direction past the knife;

a carnage assembly mounted for reciprocal movement back and forth past a cutting edge of the knife;

at least one bearing arrangement connecting the carriage assembly to the slide rod to facilitate the reciprocal movement of the carriage assembly, the bearing arrangement including a lubricant reservoir, a bearing bracket holding a bearing that rides on the slide rod, the lubricant reservoir fluidly connected to deliver lubricant to the slide rod in proximity to the bearing;

wherein the lubricant reservoir is in fluid communication with a lubricant collection and return path of the bearing bracket for delivering lubricant deposited on the slide rod back the lubricant reservoir;

wherein the lubricant reservoir is located below the slide rod, a sealing member is disposed between the bearing bracket and the lubricant reservoir;

wherein the sealing member includes a trough positioned to receive lubricant from a bearing bracket opening that forms part of the lubricant collection and return path, the trough includes a lubricant return opening for delivering lubricant back into the reservoir, the lubricant return opening offset from the bearing bracket opening.

2. The food product slicer of claim 1, further including a wick having a portion within the lubricant reservoir, the wick including another portion within the bearing bracket and in contact with an upper portion of the slide rod, the lubricant reservoir spaced below the upper portion of the slide rod.

3. The food product slicer of claim 2 wherein the lubricant collection and return path includes at least one lubricant collecting groove in the bearing bracket and facing the slide rod, the lubricant collecting groove in fluid communication with the lubricant reservoir for delivering lubricant from the slide rod back down into the reservoir.

4. The food product slicer of claim 2 wherein a temperature of lubricant in the lubricant reservoir is cooler than a temperature in the vicinity of the interface between the slide rod and the wick.

5. The food product slicer of claim 1 wherein the lubricant return opening is located toward a selected side of the reservoir such that when the selected side of the reservoir tilts upward during a slicer tilt operation, at least eighty percent of lubricant within the reservoir remains below the lubricant return opening.

6. The food product slicer of claim 1 wherein the sealing member includes a wick opening through which a wick passes, and the sealing member includes a downwardly extending wall located between the lubricant return opening and the wick opening.

7. The food product slicer of claim 1 wherein an upper side of the bearing bracket includes a lubricant refill recess into which lubricant can be delivered, a port extends from the bottom of lubricant refill recess downward to the lubricant reservoir.

8. The food product slicer of claim 1 wherein the reservoir is formed of a transparent plastic material to permit visual observation of lubricant level with the reservoir.

9. A food product slicer, comprising:

a base;

a knife mounted for rotation relative to the base;

a slide rod extending in a direction past the knife;

a carriage assembly mounted for reciprocal movement back and forth past a cutting edge of the knife;

at least one bearing arrangement connecting the carriage assembly to the slide rod to facilitate the reciprocal movement of the carriage assembly, the bearing arrangement including a lubricant reservoir located below the slide rod, a bearing bracket holding a bearing that rides on the slide rod, the lubricant reservoir connected with the bearing bracket, a wick having a lower portion within the lubricant reservoir, the wick extending upward through the bearing bracket and including a portion extending over and in contact with the top of the slide rod, the bearing bracket includes a lubricant collecting groove facing the slide rod, the lubricant collecting groove in fluid communication with the lubricant reservoir for delivering lubricant from the slide rod back down into the reservoir;

wherein a sealing member is disposed between the bearing bracket and the lubricant reservoir;

wherein the sealing member includes a trough positioned to receive lubricant from a bearing bracket opening leading from the lubricant collecting groove, the trough includes a lubricant return opening for delivering lubricant back into the reservoir, the lubricant return opening offset from the bearing bracket opening.

10. The food product slicer of claim 9 wherein the lubricant return opening is located toward a selected side of the reservoir such that when the selected side of the reservoir tilts upward during a slicer tilt operation, at least eighty percent of lubricant within the reservoir remains below the lubricant return opening.

11. The food product slicer of claim 9 wherein the sealing member includes a wick opening through which the wick passes, and the sealing member includes a downwardly extending wall located between the lubricant return opening and the wick opening.

12. The food product slicer of claim 9 wherein an upper side of the bearing bracket includes a lubricant refill recess into which lubricant can be delivered, a port extends from the bottom of lubricant refill recess downward to the lubricant reservoir.

13. The food product slicer of claim 9 wherein first and second spaced apart bearing arrangements are provided, and a flow path connects the lubricant reservoir of the first bearing arrangement and the lubricant reservoir of the second bearing arrangement to maintain substantially the same lubricant level in the two reservoirs.

14. The food product slicer of claim 9 wherein the reservoir is formed of a transparent plastic material to permit visual observation of lubricant level with the reservoir.

15. The food product slicer of claim 9 wherein the bearing bracket includes first and second lubricant collecting grooves at opposite sides of the bearing.

16. A food product slicer, comprising:

a base;

a knife mounted for rotation relative to the base;

a slide rod extending in a direction past the knife;

a carriage assembly mounted for reciprocal movement back and forth past a cutting edge of the knife;

at least one bearing arrangement connecting the carriage assembly to the slide rod to facilitate the reciprocal movement of the carriage assembly, the bearing arrangement including a lubricant reservoir located below the slide rod, a bearing bracket holding a bearing that rides on the slide rod, the lubricant reservoir connected with the bearing bracket, a wick having a lower portion within the lubricant reservoir, the wick extending upward through the bearing bracket and including a portion extending over and in contact with the top of the slide rod, the bearing bracket includes a lubricant collecting groove facing the slide rod, the lubricant collecting groove in fluid communication with the lubricant reservoir for delivering lubricant from the slide rod back down into the reservoir;

wherein an upper side of the bearing bracket includes a lubricant refill recess into which lubricant can be delivered, a first port extends from the bottom of lubricant refill recess downward to the lubricant reservoir, and the wick extends upward through a second port into and through the lubricant fill recess in order to reach the slide rod.

* * * * *